United States Patent [19]

Southern et al.

[11] 4,147,506

[45] Apr. 3, 1979

[54] METHOD AND APPARATUS FOR HEATING COILS OF STRIP

[75] Inventors: Raymond L. Southern, Lower Burrell; James G. Benford, Pittsburgh; Steve Petarra, Harwick; Robert D. Holbein, Sarver; Albert F. Vince, Leechburg, all of Pa.

[73] Assignee: Allegheny Ludlum Industries, Inc., Pittsburgh, Pa.

[21] Appl. No.: 842,183

[22] Filed: Oct. 14, 1977

[51] Int. Cl.[2] ..... F27B 9/00; F27B 11/00

[52] U.S. Cl. ..... 432/148; 266/262; 266/263; 432/206; 432/254.1; 432/254.2

[58] Field of Search ..... 432/10, 148, 206, 254.1, 432/254.2; 266/262, 263

[56] References Cited

U.S. PATENT DOCUMENTS

| | | | |
|---|---|---|---|
| 79,759 | 7/1868 | Hibell | 432/254.1 |
| 1,949,716 | 3/1934 | Harsch | 432/148 |
| 2,084,241 | 6/1937 | Capper | 432/148 X |
| 3,020,032 | 2/1962 | Casey | 432/148 X |
| 3,188,068 | 6/1965 | Schmidt | 432/206 |

FOREIGN PATENT DOCUMENTS

| | | | |
|---|---|---|---|
| 1078599 | 3/1960 | Fed. Rep. of Germany | 266/262 |

*Primary Examiner*—John J. Camby

*Attorney, Agent, or Firm*—Vincent G. Gioia; Robert F. Dropkin

[57] ABSTRACT

Coils of strip to be annealed are placed in a furnace with their eye vertical and are heated to the annealing temperature by heating elements on the furnace side wall at the same elevation as the coils. An insulation shield is provided between the heating elements and the coil. This may be a cover surrounding the coil in spaced relationship therewith and extending the full height of the coil.

12 Claims, 5 Drawing Figures

40
42
44
46
48
50
52
53
54
55
56
58
C
60
62
64
66
68
70
74
80
82
84
86
88

METHOD AND APPARATUS FOR HEATING COILS OF STRIP

This invention relates to a method and apparatus for heating coils of strip and more particularly for annealing coils of silicon steel strip. The strip is usually annealed in either a tunnel furnace or in a bell furnace. In the tunnel furnace the coils are mounted one high on a conveyor and move through the furnace from the entry to exit end. The coil is heated starting at the entry end by heating elements mounted on the sidewalls at the same elevation as the coils. In the bell furnace a coil or two or more coils one on top of the other are mounted on a base with their eyes vertical. An inner cover made of a single thickness of metal is placed over the coil and forms an enclosure for the annealing atmosphere. An outer cover is placed over the inner cover and the coil is heated by heating elements mounted on its sidewalls at the same elevation as the coil. In both types of furnaces the radiant energy from the heating elements is directed to the outer wraps of each coil. These methods of heating coils results in distorted outer wraps (as much as 3 inches in), heat tint throughout the coil, bare spots up to 3 inches into the coil, and poor base coating development. Thus, there is a reduced yield and/or poor strip appearance. It has been suggested to wrap insulation around at least the top part of the coil, but this has only been partially successful.

According to our invention we reduce the heat input to the outer wraps of the coils by minimizing the direct radiation from the heating elements. This reduces the overheating of the lateral surfaces relative to the coil ends and eliminates the problems previously discussed. Since heat transfer to the cold spot of the coil (mid-buildup and mid-width) is much easier in the axial direction than in the radial direction the time required to bring the temperature of the entire coil to the desired level is not materially affected.

The resistance of radial heat transfer per unit depth into a coil may be as much as 20 times greater than the resistance to axial heat transfer per unit depth into a coil. Thus the rate of heat supplied to the ends of the coils (i.e., axial heating) is the controlling factor in heating the coil cold spot to annealing temperature. The magnitude of this difference in resistance to heat transfer is dependent on the tightness of the coil wraps, type and thickness of strip coating (if any), type of furnace atmosphere, etc. Specifically we place an insulated radiation shield in the coil annealing furnace so the direct line of sight from the heating elements to the lateral surfaces of the coils is interrupted while leaving the top of the coil open to its usual reflected radiation. The shields will retard heat transfer by radiation, convection and conduction.

It is therefore an object of our invention to provide a method and apparatus for heating coils of strips which eliminates or greatly reduces damage to the outer wraps of the coils.

Another object is to provide an insulated inner annealing cover.

These and other objects will be more apparent after referring to the following specification and attached drawings in which FIG. 1, is a vertical schematic sectional view of a tunnel furnace incorporating one species of our invention;

Figure 1:
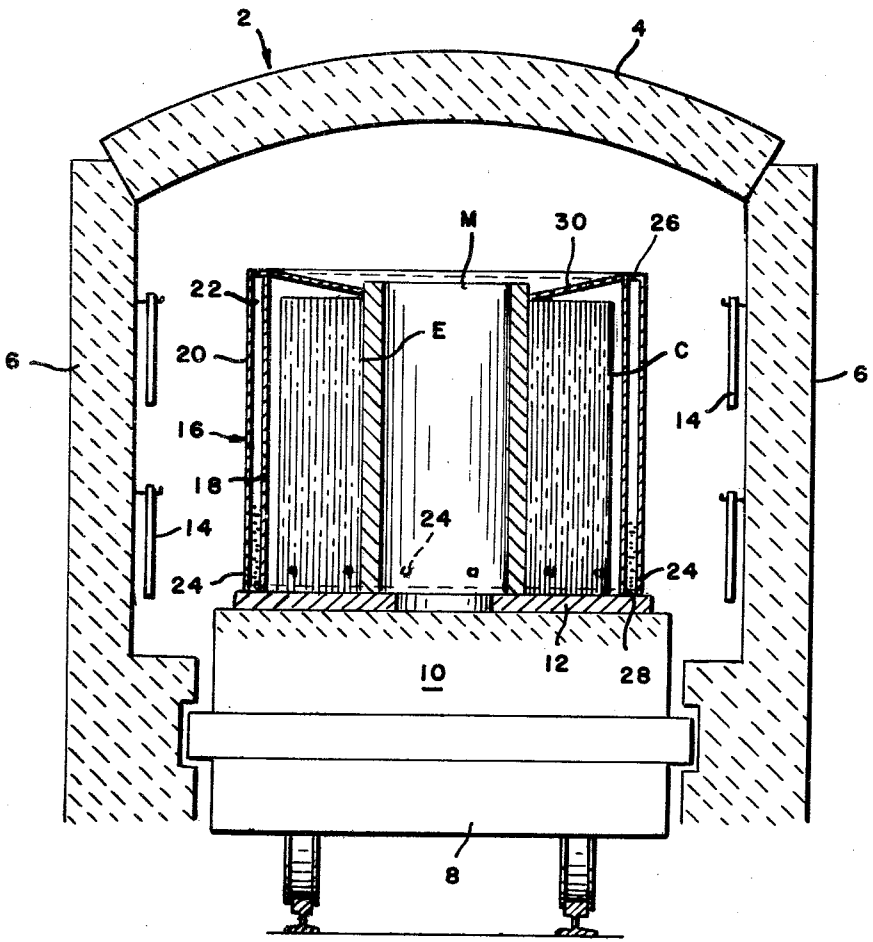

Referring more particularly to FIG. 1 of the drawings, reference numeral 2 indicates a tunnel furnace for annealing coils of strip C having an opening E therethrough with a mandrel M therein. The furnace 2 includes an arched refractory roof 4 supported by refractory side walls 6. A conveyor 8 supports a refractory base 10 having a base plate 12 thereon. Heating means, shown as electrical heating elements 14 are mounted on the side walls 6. It will be understood that other heating means, such as combustion tubes may be used in place of the electrical heating elements. While only one coil of strip C is shown it will be understood that a plurality of coils will be mounted on base plate 12 or on a plurality of spaced apart base plates with the coils being charged into one end of the furnace and discharged from the other end. All the above construction and procedure are conventional.

According to our invention we provide an insulated radiation shield 16 around each coil C. The shield 16 consists of concentric metal cylinders 18 and 20 with a space 22 therebetween which may be between ¾ and 1 inch wide. Vent holes 24 are provided adjacent the bottom of outer cylinder 20 to equalize the pressure of space 22 with that of the furnace atmosphere. The space 22 between the cylinders are closed at the top and bottom by rings 26 and 28. A doughnut shaped collar 30 made of a single thickness of metal extends from the top edge of the shield 16 to the mandrel M to maintain the shield in position during its travel through the furnace. Centering may be also accomplished by means of grooves in the base plate 12. The walls of the cylinders act as radiant heat shields with the gas in the space 22 providing thermal insulation. If desired or when found advisable, the space 22 may be filled with a high temperature insulation.

Figure 2:
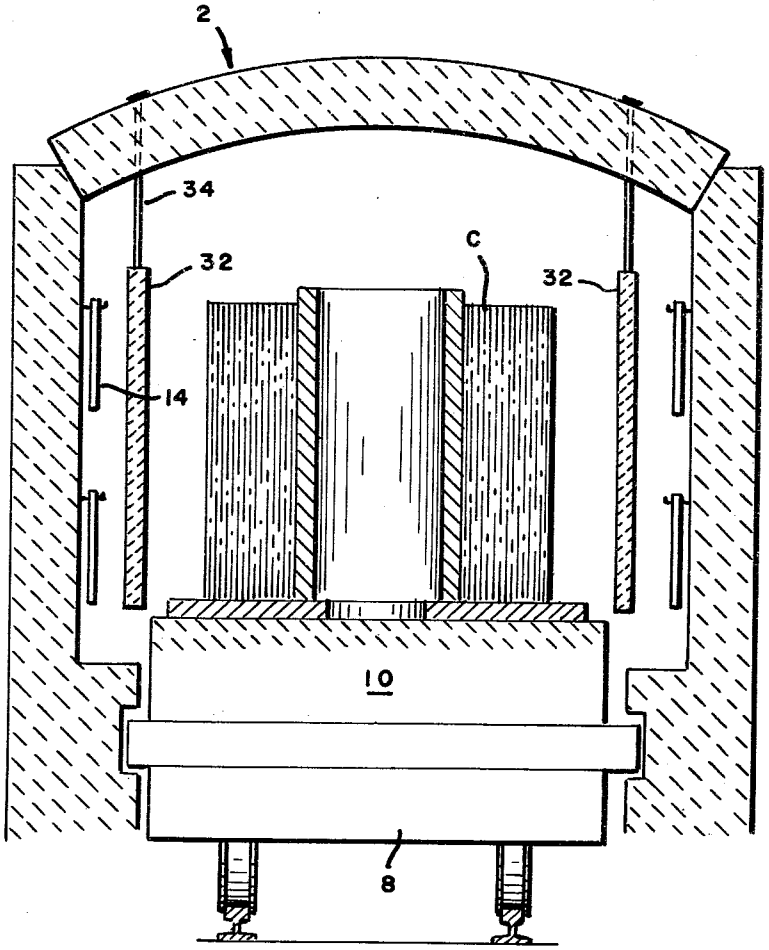
FIG. 2 is a view, similar to FIG. 1, showing a second embodiment of our invention.

FIG. 2 discloses a different type of heat shield in the tunnel furnace 2. In this embodiment, an insulated member 32 extends longitudinally along each side of the furnace 2 between the heating elements and the coil C. The members 32 may be supported in any suitable manner such as by roof hangers 34 which may be made of a refractory or molybdenum. The members 32 need not extend the full length of the furnace, but must be present during the heating up process. Since it is desired to keep the weight of the members 32 to a minimum they are preferably made from refractory fiber boards or a refractory fiber blanket attached to a thin metal sheet. It will be seen that the members 32 shield the lateral surfaces of the coils from the heating elements 14, but permit gas circulation between the coils and elements 14.

Figures 3, 4, 5:
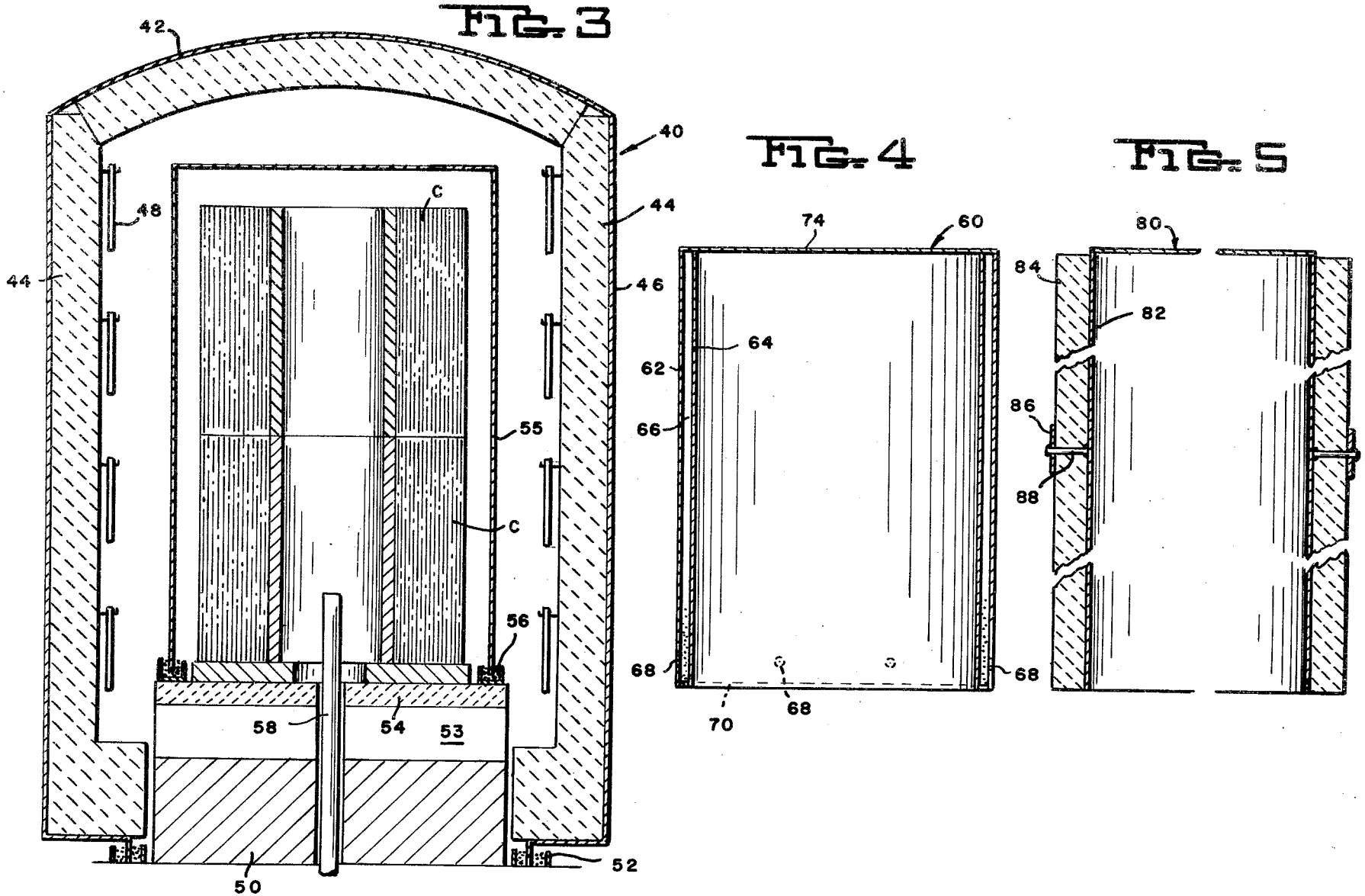
FIG. 3 is a view, similar to FIG. 1, showing a conventional bell type annealing furnace.
FIG. 4 is a sectional view of an inner cover of our invention.
FIG. 5 is a sectional view of another inner cover of our invention.

Referring now to FIG. 3, reference numeral 40 indicates the movable outer cover or heating portion of a bell type furnace. The cover 40 includes a refractory roof 42 supported by refractory walls 44 and all surrounded by a metal shell 46. Heating elements 48, similar to the heating elements 14, are mounted in the outer cover 40. The furnace also includes a refractory base 50 having a sand seal 52 at its bottom for receiving the outer cover 40. Mounted on top of base 50 is an open support base 53 with a refractory hearth plate 54 thereon. The furnace shown only shows a base for supporting a single coil or two coils one above the other so that only a single sand seal 56 is mounted on top of plate 54. However, it will be noted that the base may be designed to support a plurality of coils side by side with a sand seal for each and with an annealing gas inlet pipe 58 for each sand seal 56. In operation, a coil or coils of strip are mounted on the hearth plate 54 and an inner cover 55 conventionally made of a single layer of metal is positioned over each coil mounted on the base with its lower end mounted in sand seal 56. The outer cover 40 is then lowered over the outer cover or covers into the sand seal 52. Annealing gas is delivered through pipe 58 into the inner cover during the heating cycle. The above construction and operation are conventional.

According to our invention we replace the conventional inner cover with an insulated inner cover 60 shown in FIG. 4. This includes concentric metal cylinders 62 and 64 with a space 66 therebetween which may be between ¾ and 1 inch wide. Vent holes 68 are provided adjacent the bottom of outer cylinder 62 to equalize the pressure in space 66 with that of the atmosphere in the inner cover 60. A plate 70 closes the bottom of space 66. A single plate 74 closes the top of the cover and the space 66. The operation of this shield is essentially the same as that of FIG. 1 and like that of FIG. 1 the space 66 may be filled with insulation.

FIG. 5 shows another inner cover 80 which may be used in place of cover 60. In this embodiment, the vertical metal wall 82 of a conventional inner cover is surrounded by a ceramic fiber blanket 84 held in place in any suitable manner such as by means of a plurality of washers 86 each secured to one end of a stud 88 having its other end secured to wall 82. Like cover 60 the top of this cover is not insulated.

While several embodiments have been shown and described in detail, it will be readily apparent to those skilled in the art that various adaptations and modifications may be made within the scope of the invention.

We claim:

1. Apparatus for heating a coil of strip metal having an axial opening therethrough which comprises a furnace having a roof, a base for supporting said coil with its axial opening substantially vertical and wall means extending between said base and roof, heating means located in said furnace adjacent said wall means in horizontally spaced relationship with said coil supported on said base, and insulated radiation shield means supported in said furnace between said heating means and said supported coil said shield comprising at least two sheets with a space therebetween said space sealed at the ends thereof, and vent holes located in the outer sheet, the top end of said coil being relatively free of insulation.

2. Apparatus according to claim 1 in which said shield means includes coaxial cylindrical sheets surrounding said coil for the full height thereof.

3. Apparatus according to claim 2 including heat insulation in said space between said cylinders.

4. Apparatus according to claim 1 in which said furnace is a tunnel furnace having a conveyor for supporting said base with a plurality of coils mounted thereon with a shield surrounding each coil, each shield including coaxial cylinders with a space therebetween, means for sealing the ends of the space between said cylinders, and vent holes at the lower end of the outer cylinder, said cylinders being mounted on said base and said shield extending the full height of the surrounded coil.

5. Apparatus according to claim 4 including heat insulation in said space between said cylinders.

6. Apparatus according to claim 4 including means for holding each of said shields in centered position around its associated coil.

7. Apparatus according to claim 1 in which said furnace is a tunnel furnace having a conveyor for supporting said base with a plurality of coils mounted thereon, said shield means including an insulated member extending longitudinally along each side of the furnace between the heating means and the coils said member comprising at least two sheets with a space therebetween, said space sealed at the ends thereof, and vent holes located near the lower portion of the outer sheet, and means for supporting said members on said furnace with their lower ends extending to the bottom of the coils and their upper end extending to the top of the coils.

8. Apparatus according to claim 1 in which said shield means is an inner cover which said inner cover includes coaxial metal cylinders surrounding said coil for the full height thereof and a single metal plate attached to the top of said cylinders forming a closed roof.

9. Apparatus according to claim 1 including heat insulation in said space between said cylinders.

10. An inner cover for annealing coils of strip comprising an insulated cylindrical side wall including a first metal cylinder, a second metal cylinder surrounding said first metal cylinder coaxial therewith, said second cylinder being spaced from said first cylinder to provide a space therebetween and a single metal plate attached to the top of said cylinders and forming a closed roof means for sealing the ends of the space between said cylinders, and vent holes at the lower end of the outer cylinder.

11. An inner cover according to claim 10 including heat insulation in said space between said cylinders.

12. An inner cover according to claim 10 including heat insulation attached to and surrounding the outer periphery of said cylinder.

* * * * *